US006966450B2

(12) United States Patent
Askew

(10) Patent No.: US 6,966,450 B2
(45) Date of Patent: Nov. 22, 2005

(54) PARTITIONED ICE CHEST

(76) Inventor: Stacy W. Askew, 296 Wilkerson Rd., Natchitoches, LA (US) 71457

( * ) Notice: Subject to any disclaimer, the term of this patent is extended or adjusted under 35 U.S.C. 154(b) by 0 days.

(21) Appl. No.: 10/448,281

(22) Filed: May 30, 2003

(65) Prior Publication Data

US 2004/0238543 A1 Dec. 2, 2004

(51) Int. Cl.[7] ..... B65D 1/24; B65D 25/04; B65D 57/00; B65D 85/00; B65N 1/36

(52) U.S. Cl. ..... 220/529; 220/533; 62/457.7

(58) Field of Search ..... 220/529, 554, 220/510, 592.01, 23.83, 533, 532, 512, 216, 220/578, 915.1, 915.2, 500, 544; 62/382, 62/372, 457.1, 457.7, 459; 206/514, 559, 206/139, 425; 229/545, 120.02, 120.06, 120.07; 217/7; 190/9, 109, 110

(56) References Cited

U.S. PATENT DOCUMENTS 2,504,911 A 4/1950 Whitecar
2,610,759 A * 9/1952 Slade ..... 220/533
3,200,983 A * 8/1965 Walter ..... 220/533
4,261,465 A 4/1981 Thomas
4,441,336 A 4/1984 Cannon
RE32,740 E 8/1988 Steffes
4,964,528 A 10/1990 Wagoner
5,052,185 A * 10/1991 Spahr ..... 62/60
5,103,998 A * 4/1992 Caro et al. ..... 220/533
5,163,547 A 11/1992 Hsieh
6,039,202 A 3/2000 Olstad et al.

* cited by examiner

*Primary Examiner*—Nathan J. Newhouse
*Assistant Examiner*—Harry Grosso
(74) *Attorney, Agent, or Firm*—Stephen R. Greiner

(57) ABSTRACT

A partitioned ice chest including an insulated box with a bottom wall and an open top. Front, back and opposed side walls extend upwardly from the bottom wall. A removable lid closes the open top. Vertical slots are provided in the side walls. A partition can be oriented vertically or horizontally within the box. Tabs extending from the partition are slidably positioned within the slots to prevent the partition from sliding about.

3 Claims, 1 Drawing Sheet

PARTITIONED ICE CHEST

FIELD OF THE INVENTION

The present invention relates generally to compartmented containers with partitions that are movable or removable and, more particularly, to such containers wherein the partitions are received in a plurality of grooves or notches therein.

BACKGROUND OF THE INVENTION

Anyone who has used a conventional, ice chest knows how rapidly things placed within it become wet. Over time, ice placed in the chest melts and tends to submerge all of food items that accompany it. This is not a significant problem if the items are packed in cans, bottles or heavy, sealed containers but is a significant problem if the food items are more lightly packed as sandwiches and chips typically are. In the latter case, it is possible that the affected items will be completely ruined when dunked.

Some have proposed the positioning of shelves or other partitioning devices in ice chests to separate food items from melting ice. Unfortunately, these proposals have not been entirely satisfactory since the partitions are not easily stowed away when their use is not required. Furthermore, a significant portion of the cargo-carrying capacity of the ice chest is lost while toting around the temporarily unneeded partition. A need, therefore, exists for an ice chest whose interior space can be easily divided into separate compartments by a partition that can be stored in the chest in a manner that does not significantly reduce the capacity of the unpartitioned space.

SUMMARY OF THE INVENTION

In light of the problems associated with conventional, ice chests, it is a principal object of the invention to provide an ice chest whose contents can be divided by a movable partition into a pair of separate compartments. These compartments can be positioned side by side or they can be vertically stacked. When not needed, the partition can be stowed within the ice chest in a manner that boosts the insulative quality of the ice chest yet does not noticeably reduce the storage capacity of the ice chest.

It is an object of the invention to provide improved elements and arrangements thereof in a partitioned ice chest for the purposes described which is lightweight in construction, inexpensive to manufacture, and dependable in use.

Briefly, the ice chest in accordance with this invention achieves the intended objects by featuring an insulative box having a rectangular bottom wall from which a front wall, a back wall and a pair of opposed, side walls extend upwardly to define an open-topped container. Each of the side walls is provided with a number of vertical slots. One of the slots is positioned adjacent the front wall and another one of the slots is positioned adjacent the back wall. A partition is removably positioned within the box and has a rectangular plate with tabs extending from its corners for slidable positioning within the slots. The partition is configured such that each of the tabs is received in a slot to support and guide the plate whether the partition is vertically or horizontally oriented within the box.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
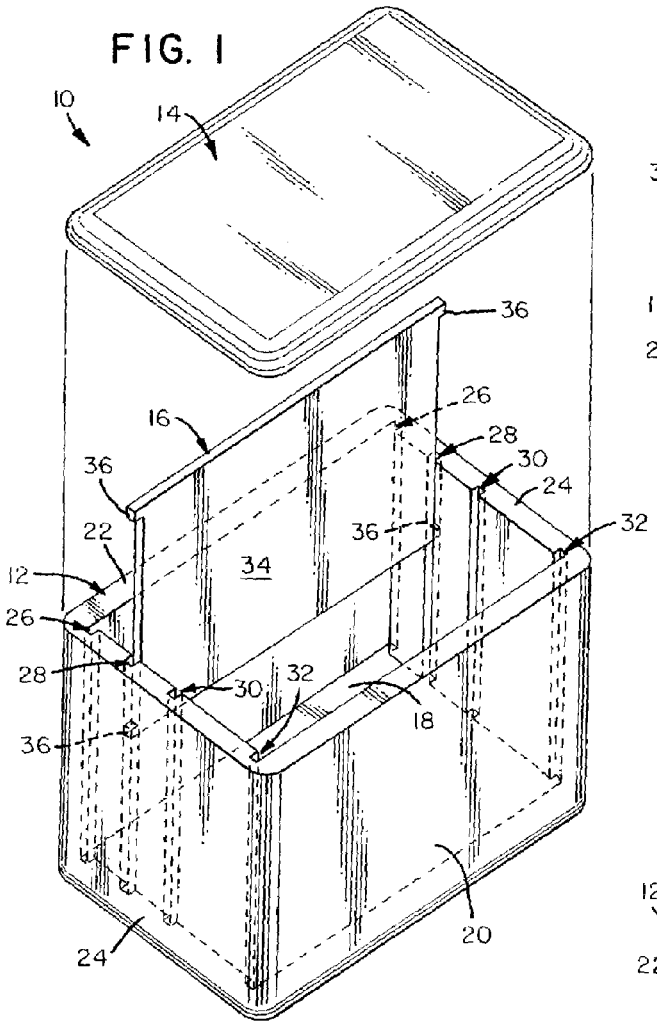
FIG. 1 is an exploded, perspective view of a partitioned ice chest in accordance with the present invention.
Figure 2:
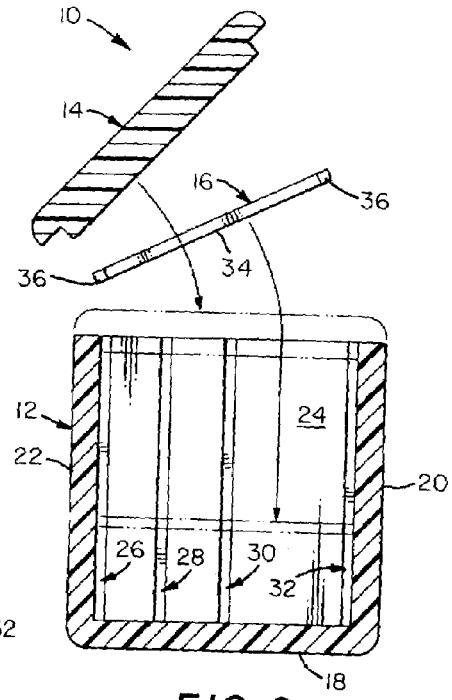
FIG. 2 is an exploded, side view of the ice chest of FIG. 1 with portions broken away to reveal details thereof showing the partition of the ice chest being positioned so as to divide the ice chest horizontally.
Figure 3:
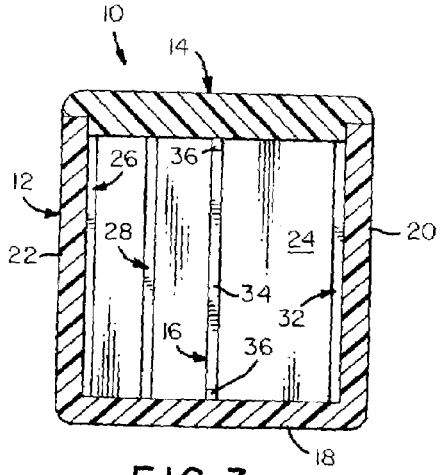
FIG. 3 is a side view of the ice chest with portions broken away to reveal details thereof showing the partition positioned so as to divide the ice chest vertically.

Referring now to the FIGS., a partitioned ice chest in accordance with the present invention is shown at 10. Ice chest 10 includes an insulative box 12 with a removable lid 14 for selectively closing box 12. A partition 16 is located within box 12 to divide box 12 vertically or horizontally into a compartmented space. If desired, partition 16 can be stored in a nonuse position within box 12 such that the interior of box 12 is undivided.

Insulative box 12 includes a rectangular bottom wall 18 from which a front wall 20, a back wall 22 and a pair of opposed, side walls 24 extend upwardly to define an open-topped container. Walls 18–24 are integrally formed of a material, such as Styrofoam, that transfers heat at a low rate. Of course, this material can be provided with a coating (not shown) of hard plastic or other suitable substance to make box 12 more durable. Alternatively, walls 18–24 can be made hollow to reduce heat transfer rates to a minimum.

Side walls 24 are provided with vertical slots 26, 28, 30 and 32 along their lengths for snugly and slidably receiving partition 16. As shown, slots 26 are located at the junctions of back wall 22 and side walls 24. Slots 32, however, are located at the junctions of front wall 20 and side walls 24. Preferably, slots 30 are located midway between slots 26 and 32 and slots 28 are located midway between slots 26 and 30. All of slots 26–32 extend from the top to the bottom of side walls 24.

Partition 16 includes a rectangular plate 34 with one of a plurality of small tabs 36 extending from each of the four corners thereof. When plate 34 is oriented vertically within box 12, tabs 36 at each end of plate 34 slide within one of the opposed pairs of slots 26–32. However, when plate 34 is oriented horizontally in box 12, tabs 36 at each end of plate 34 slide in slots 26 and 32 of the adjacent side wall 24. Because plate 34 and tabs 36 are preferably formed from a single sheet of insulative material having a thickness substantially equal to the width of slots 26–32, partition 16 can be positioned flush against the inner surfaces of front wall 20 in slots 32 and against back wall 22 in slots 26 when it is not needed. Similarly, partition 16 can be pressed flat against inner surface of bottom wall 18 for storage.

Use of ice chest 10 is straightforward once it is decided how the interior of box 12 is to be divided. If a vertical partitioning is chosen, partition 16 is, first, inserted into either slot 28 or slot 30. Then, ice or other selected items (not shown) are positioned within box 12 on opposite sides of partition 16. If, however, it is decided to horizontally partition the interior of box 12 (to keep dry items separated from melting ice located in the bottom of box 12, for example), then ice is positioned in the bottom of box 12 with partition 16 and items to be kept dry being stacked atop the ice. In either case, after placing all of the chosen items and partition 16 in box 12, lid 14 is placed atop walls 20–24 to close box 12 to prevent the influx of warm air.

If no partitioning of box 12 is desired, partition 16 may be placed in one of three, out-of-the-way, storage positions within the box 12. For example, partition 16 can be placed against back wall 22 by positioning tabs 36 within slots 26 or can be positioned against front wall 20 by positioning tabs 36 within slots 32. A final storage position has partition 16 positioned flat against the inner surface of bottom wall 18 with tabs 36 in slots 26 and 32. In all storage positions, partition 16, preferably being formed form an insulative material, enhances the insulative qualities of box 12. After use, all of the parts of ice chest 10 can be washed with soap and water and stored fully assembled in a handy location for immediate reuse.

While the invention has been described with a high degree of particularity, it will be appreciated by those skilled in the art that modifications may be made thereto. For example, partition 16 may be provided with one or more finger holes to permit such to be more easily retrieved from a storage location against bottom, front or back walls 18, 20 or 22. Therefore, it is to be understood that the present invention is not limited to the sole embodiment described above, but encompasses any and all embodiments within the scope of the following claims.

I claim:

1. A partitioned ice chest, comprising:

an insulative box including a rectangular bottom wall from which a front wall, a back wall and a pair of opposed, side walls extend upwardly to define an open-topped container, each of said side walls being provided with a plurality of vertical slots;

a partition removably positioned within said insulative box, said partition having a rectangular plate with one of a plurality of tabs extending from each of the four corners thereof for slidable positioning within one of said slots; said plate and said tabs being configured such that when said plate is oriented vertically within said insulative box, said tabs at each end of said plate slide within one of said slots and, when said plate is oriented horizontally in said box, said tabs at each end of said plate slide within a pair of said slots; and, a lid removably positioned atop said front, back and side walls for selectively closing said insulative box.

2. A partitioned ice chest, comprising:

an insulative box including a rectangular bottom wall from which a front wall, a back wall and a pair of opposed, side walls extend upwardly to define an open-topped container, each of said side walls being provided with a plurality of vertical slots, one of said slots being positioned adjacent said front wall and another one of said slots being positioned adjacent said back wall;

a partition removably positioned within said insulative box, said partition having a rectangular plate with one of a plurality of tabs extending from each of the four corners thereof for slidable positioning within one of said slots; said plate and said tabs being configured such that when said plate is oriented vertically within said insulative box, said tabs at each end of said plate slide within one of said slots and, when said plate is oriented horizontally in said box, said tabs at each end of said plate slide within said slots adjacent said front and back walls; and, a removable lid removably positioned atop said front, back and side walls for selectively closing said insulative box.

3. A partitioned ice chest, comprising:

an insulative box including a rectangular bottom wall from which a front wall, a back wall and a pair of opposed, side walls extend upwardly to define an open-topped container, each of said side walls being provided with a plurality of vertical slots, one of said slots being positioned adjacent said front wall and another one of said slots being positioned adjacent said back wall, and still another pair of said slots being spaced away from said front and back walls;

a partition removably positioned within said insulative box, said partition having a rectangular plate with one of a plurality of tabs extending from each of the four corners thereof for slidable positioning within one of said slots; said plate and said tabs being configured such that when said plate is oriented vertically within said insulative box, said tabs at each end of said plate slide within one of said slots and, when said plate is oriented horizontally in said box, said tabs at each end of said plate slide within said slots adjacent said front and back walls; and, a removable lid removably positioned atop said front, back and side walls for selectively closing said insulative box.

* * * * *